US008810361B2

(12) United States Patent
Thukral et al.

(10) Patent No.: US 8,810,361 B2
(45) Date of Patent: Aug. 19, 2014

(54) ELECTRONICALLY AUGMENTED SMART LOCK FOR TRASH CONTAINERS

(75) Inventors: Dhruv Thukral, Los Angeles, CA (US); Viviane Soraya Ghaderi, Los Angeles, CA (US); Shervin Moloudi, Los Angeles, CA (US)

(73) Assignee: Shervin Moloudi, Los Angeles, CA (US)

( * ) Notice: Subject to any disclaimer, the term of this patent is extended or adjusted under 35 U.S.C. 154(b) by 191 days.

(21) Appl. No.: 13/569,896

(22) Filed: Aug. 8, 2012

(65) Prior Publication Data

US 2013/0087562 A1 Apr. 11, 2013

Related U.S. Application Data

(60) Provisional application No. 61/521,380, filed on Aug. 9, 2011.

(51) Int. Cl.
*E05B 17/00* (2006.01)

(52) U.S. Cl.
USPC ..... 340/5.2; 340/5.28; 340/5.6; 220/315; 220/833; 70/158; 70/110

(58) Field of Classification Search
USPC ..... 340/5.2, 5.28, 5.6; 220/315, 833; 70/158, 110
See application file for complete search history.

(56) References Cited

U.S. PATENT DOCUMENTS

| | | | | |
|---|---|---|---|---|
| 4,155,584 | A * | 5/1979 | Pracchia | 294/68.26 |
| 5,094,358 | A * | 3/1992 | Serio, Sr. | 220/315 |
| 5,224,743 | A * | 7/1993 | Dawdy et al. | 292/228 |
| 5,415,314 | A * | 5/1995 | McCollum | 220/315 |
| 5,738,395 | A * | 4/1998 | Probst | 292/230 |
| 6,212,923 | B1 * | 4/2001 | Clark | 70/416 |
| 6,808,080 | B2 * | 10/2004 | Spiers et al. | 220/263 |
| 8,485,382 | B2 * | 7/2013 | Raghunathan et al. | 220/324 |
| 2008/0169289 | A1 * | 7/2008 | Dawn | 220/315 |

* cited by examiner

*Primary Examiner* — Andrew Bee

(57) ABSTRACT

A smart lock that can be built into or mounted onto a trash container with a lid and a can consists of two interlocking parts. The smart lock contains a primary lock operably connected to a secondary lock. The primary lock can be opened in presence of the trash collection vehicle or by a command from the owner. The secondary lock can be opened by the same conditions or when it senses mechanical and gravitational movement characteristics of the collection process, only when the first lock is open. Each lock comprises a timer and electronic circuitry that detects authorized commands and opens the lock.

30 Claims, 11 Drawing Sheets

ELECTRONICALLY AUGMENTED SMART LOCK FOR TRASH CONTAINERS

This patent application claims priority to and the benefit of U.S. patent application Ser. No. 61/521,380, filed Aug. 9, 2011 and entitled "Electronically Augmented Mechanical Trash Container Locking Mechanism", the entire content of which is herein incorporated by reference.

BACKGROUND OF THE INVENTION

1. Field of the Invention

The disclosures relate to security and locking mechanisms of residential and commercial trash containers.

2. Description of Prior Art

Commercial and residential trash containers that are designed to be used by garbage collection agencies are usually large containers, which are covered by a lid. There are reasons to lock this lid securely including dispersion of trash due to wind, break-in by animals, and unauthorized access by individuals. Therefore, provisions are often made to lock the lid of a trash container.

In its most basic form, the weight of the lid itself can prevent access to the trash container. This can be combined with a hinge or a sliding mechanism to ensure proper enclosure. When the weight is not sufficient to securely lock the trash can a mechanical latch and/or a lock is usually added that can only be opened by a key.

Such measures can be ineffective or difficult to use as far as the collection process is concerned. A mechanical key usually requires that the operator exit the collection truck to open the container. The operator must also carry and keep track of a large number of keys which can be difficult to manage. Inventions such as U.S. Pat. No. 4,155,584 and U.S. Pat. No. 4,182,530 have been disclosed that take advantage of the mechanical movement of the trash container during the collection process, the weight of the content, the force of gravity, or a combination of these, to unlock upon collection and relock after the container returns to the upright position.

Attempts have been made to refine and improve variants of the mechanical arrangement described above (U.S. Pat. No. 5,015,021, U.S. Pat. No. 7,597,365, U.S. Pat. No. 6,666,485, U.S. Pat. No. 5,085,341, and U.S. Pat. No. 5,213,382.) However, most of the above solutions require complex mechanical parts, which are difficult to retrofit into existing trash and recycling containers. Also, most of these solutions are designed for heavy-duty commercial or bulk trash containers instead of common residential containers, which are usually made of a light material such as plastic or aluminum. Gravity operated mechanisms work for commercial and bulk containers because it is difficult for an individual to pick up and tilt them upside down to circumvent the locking mechanism. Most residential containers, however, can be easily flipped over, compromising the lock. Therefore, such gravity operated locks for residential trash containers are not practical. This invention substantially addresses these issues and others.

SUMMARY OF THE INVENTION

The proposed invention employs a multi step electronically augmented smart locking mechanism for trash containers. The smart lock is attached to the trash container and, in accordance with several embodiments disclosed herein, can be locked and unlocked using electrical, mechanical or a combination of electro-mechanical stimuli.

The lock described herein accomplishes two purposes. First, it allows the owner of the container to unlock it to deposit trash and securely lock it again. Secondly, the locking mechanism correctly recognizes the presence of the collection vehicle and unlocks the container without requiring the operators to employ any additional manipulation other than the ones employed in the daily process of garbage collection.

In one aspect of the present invention, a smart lock locks a trash container in a manner, which prevents the container from being unlocked by tilting and other methods that might be employed to force open the container.

In several embodiments related to this aspect, the smart lock assembly includes one part that can be mounted onto the lid of the trash container and another part that can be mounted onto the trash can. These two parts will interlock through mechanisms to be described below. The top and the bottom parts of the lock may or may not be interchangeable as far as the assembly on the trash container is concerned. Such a smart lock can either retrofit onto existing trash and recycling containers or it can be incorporated into new constructions of such containers.

In several of the embodiments related to this aspect, the smart lock assembly consists of at least two locks referred to herein as the primary lock and the secondary lock.

In at least one of the embodiments, the primary lock is a small but precise contraption that only opens and/or closes upon the correct detection of the presence of an authorized signal. This signal can be applied by the owner or can be generated by the presence of an authorized collection vehicle. Because of the precision of the primary lock it may have fine features such as small size or low consumption of electricity and, therefore, it may be insufficient to prevent forceful opening of the trash container. The secondary lock is a stronger and larger lock that can be opened by a much coarser mechanism, for example when the owner twists a handle or when the truck lifts the container and the acceleration or the force of gravity is applied to the lock, or a certain movement signature is detected. The secondary lock only opens if the primary lock has already opened and, therefore, the primary lock acts as an enabling agent for the second lock.

In another aspect of the invention, the smart lock includes mechanisms to correctly recognize authorized conditions for unlocking the container by the owner of the container. In at least one of the embodiments, the owner unlocks the primary lock using electrical or mechanical stimuli, which also opens the secondary lock, and allows the owner to open the trash container.

Another aspect of the invention relates to the unlocking of the smart lock by collection vehicle operators without requiring the vehicle operators to employ any additional manipulation, which would interrupt the daily collection process. In at least one of the embodiments, a device, such as a remote key, uses electrical stimuli to unlock the primary lock. In at least one embodiment, the unlocking of the primary lock in combination with another electrical or mechanical stimulus, such as the collection vehicle lifting the trash container or the force of gravity, opens the trash container during collection.

As such, the owner of the container can use a signal to lock it when it is placed on the curb on collection day. When the collection vehicle arrives a transmitter on the truck can unlock the primary lock on the container. When the container is picked up or turned upside down the motion can open the secondary lock, which opens the container. After the container is placed back the owner can use the remote controller to lock the container again.

In one form of this invention when the primary lock opens it remains open for a certain preset period of time after which it automatically closes. The same applies to the second lock. This provides not only an automatic mechanism to relock the container after it is opened, it also provides an additional level of security. For example if the presence of the collection truck is sensed but the trash is not collected, and the primary lock is left open indefinitely, the secondary lock may be compromised by intruders if they apply the coarse mechanical motion or electric stimulus that is needed to open the secondary lock. This will also minimize the effort on the side of the container owner to keep it locked.

In one variation of this scheme, one or both of the timers can be programmed to open the locks at predefined times. This can be useful if the collection schedule is known and also if the trucks cannot be equipped with the transmitters needed to send the signal to the smart lock.

This invention can include a fault detection module that can detect conditions in which the lock is not operating properly, such as low battery which by default unlocks or locks the smart lock according to a predefined setting.

Another aspect of this invention is the way energy is supplied to the lock. In one embodiment, where the energy consumption of the lock is low, a solar panel can be attached or built into the surface of the trash container to obtain solar energy. In another embodiment, the lock can be energized by batteries that can be replaced or recharged. In yet another embodiment, energy can be harvested from the mechanical movement of the trash container. In an implementation of this embodiment the mechanical movement of the container, or of the moving parts of the collection truck, can compress a spring or similar energy storing mechanism.

DETAILED DESCRIPTION OF THE INVENTION

The smart lock inventions and its embodiments disclosed herein are described as applied to a residential trash container. However, these inventions can be applied to a broad range of applications which require secure locking and unlocking mechanisms, for example, but without limitation, commercial trash containers, storage and construction containers, and gated fences.

Figure 1:
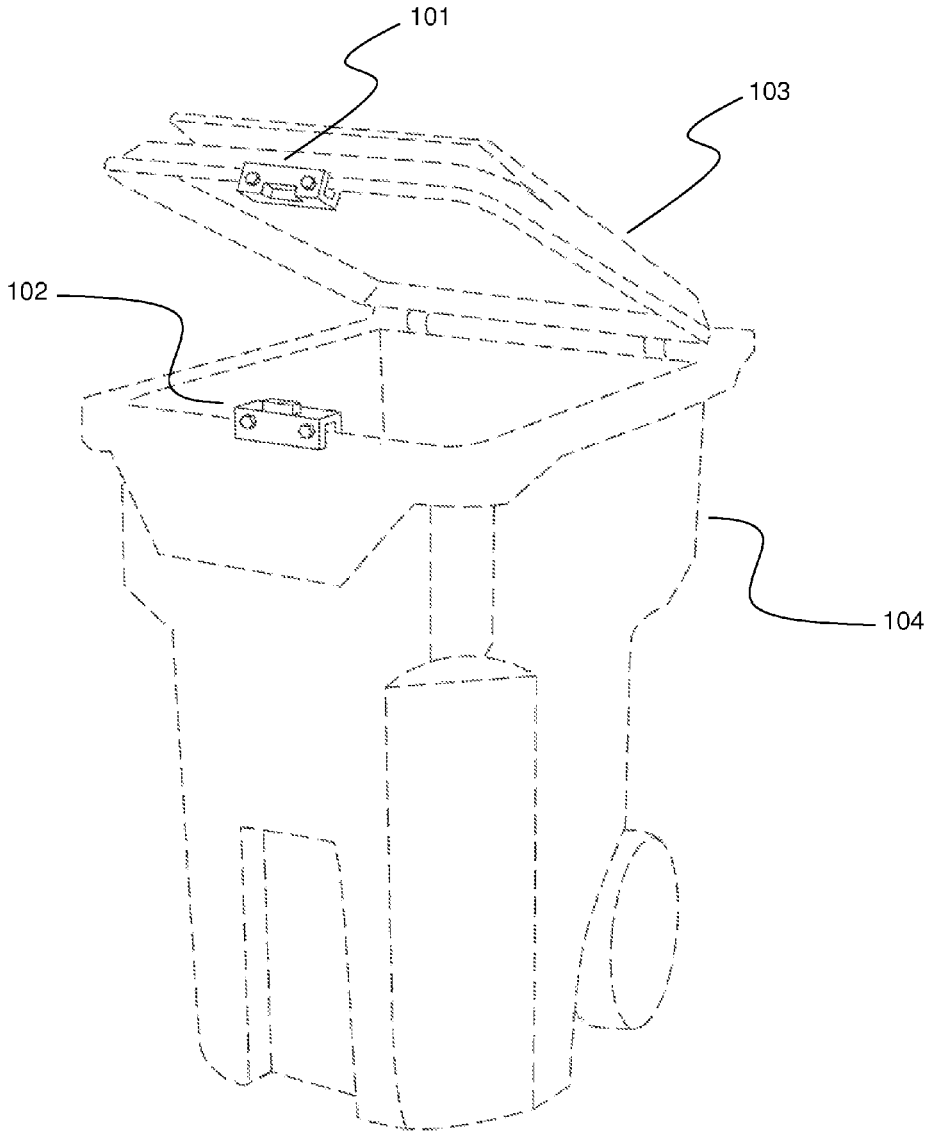
FIG. 1 is a front perspective view of a conventional residential trash container, including the trash can, the lid, and the smart lock assembly of the present invention.
Figure 2:
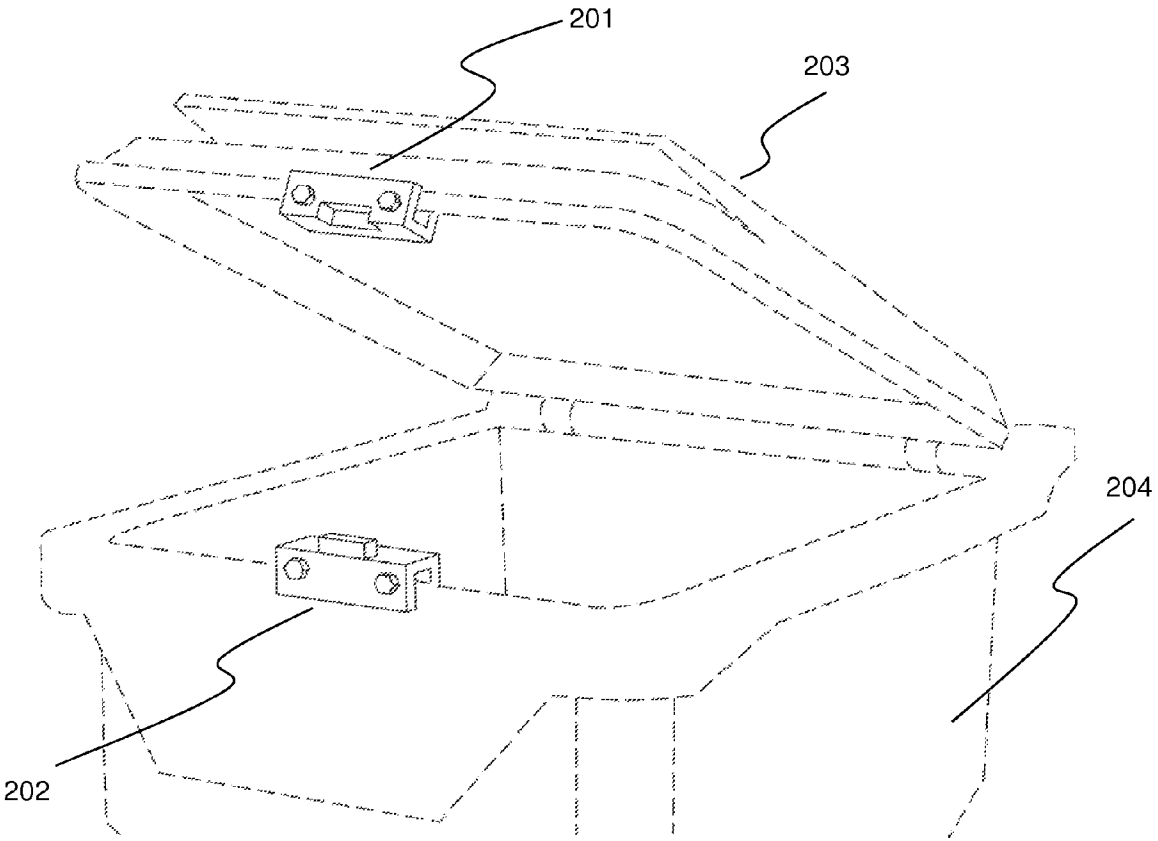
FIG. 2 is a partial perspective view of FIG. 1, showing the top of the trash container with an open lid and the smart locking assembly of the present invention.
Figure 3:
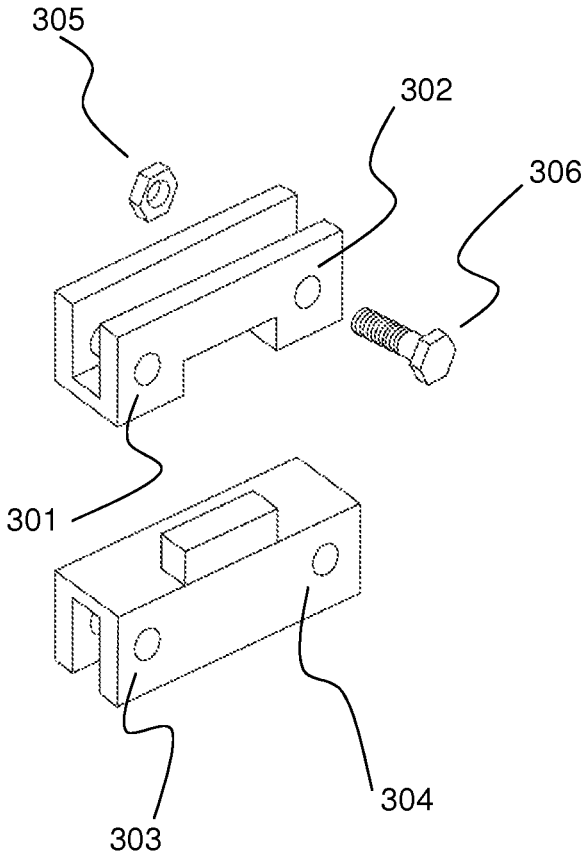
FIG. 3 shows a front perspective view of the standalone smart locking assembly including a top part that can be mounted onto the lid and a bottom part that can be mounted onto the trash can.

In one embodiment, depicted in FIG. 1, the smart lock 101-102 can be retrofitted onto an existing trash can 104 and its lid 103. In another embodiment, the smart lock can be incorporated into the trash can during the manufacturing process. The smart lock in FIG. 2 can consist of a top 201 and a bottom part 202 that latch into each other and are affixed onto parts of the trash container. In the illustrated embodiment of FIG. 2, the two parts are bolted onto the trash container lid 203 and the can 204. FIG. 3 is the general outline of the two parts of the lock. At least four holes 301-304 allow the locks to be mounted on the lids securely, for example with a bolt 306 and a nut 305.

The two parts can interlock in a variety of mechanical and electrical ways. In the exemplary depiction of FIG. 4, the bottom part 402 has a protruding section 408 that can fit into the recessed side 407 of the top part 401. The shape of the parts of the smart lock and the smart lock's arrangement are not unique. A variety of interlocking mechanisms of the two pieces are disclosed in the claims of this patent.

Figure 4:
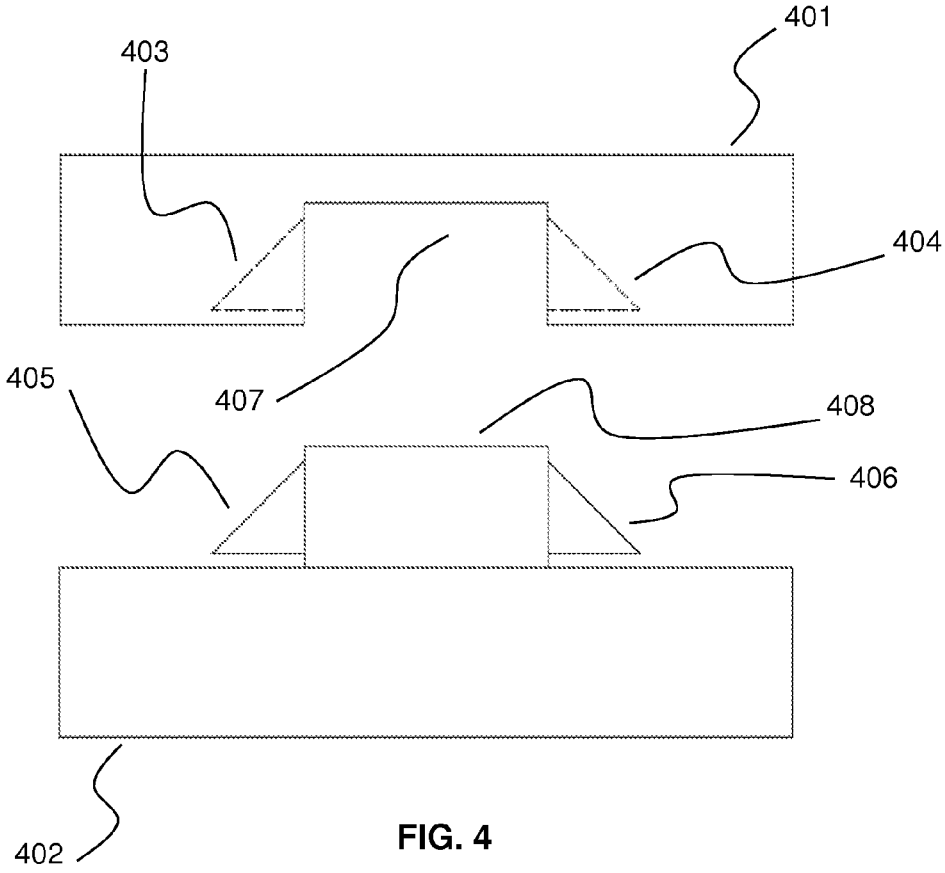
FIG. 4 is a front view of the smart locking assembly with partial details shown.

The implementation of the interlocking mechanism is shown in FIG. 4. The protruding part 408 of one half of the lock assembly 402 includes two wedge shaped latches 405, 406 that can provide the interlocking. Once the two parts of the smart lock 401, 402 are pushed together, 405 and 406 latch into the matching cavities 403 and 404, and stay locked until the smart locking mechanism comprising the primary and secondary locks allows the release of the latches, thereby unlocking the trash container.

The unlocking of the primary lock is initiated in one of two ways: either the presence of the collection vehicle is sensed by the smart lock or the owner issues an unlock signal in ways described below. Herein these are referred to as primary lock authentication scenarios.

There are many types of locks that can be employed to implement the primary lock. In one embodiment magnetic force can act on pieces of metal to keep them together until the force is removed by proper authentication, hence allowing the lock to open. A common example of this is an electromagnetically driven latch. Another embodiment of the primary lock takes advantage of the force of vacuum to bring separate parts together, thereby interlocking them. Yet another embodiment is to use a hydraulic mechanism in the primary lock to accomplish the same locking effect.

There are many ways to implement the unlocking aspect of the primary lock. To unlock the smart lock for the collection process, in one possible embodiment, the primary lock detects the presence of the collection vehicle through electrical signals. These electrical signals have unique patterns that can be applied to the lock via direct contact with parts of the collection vehicle.

Figure 5:
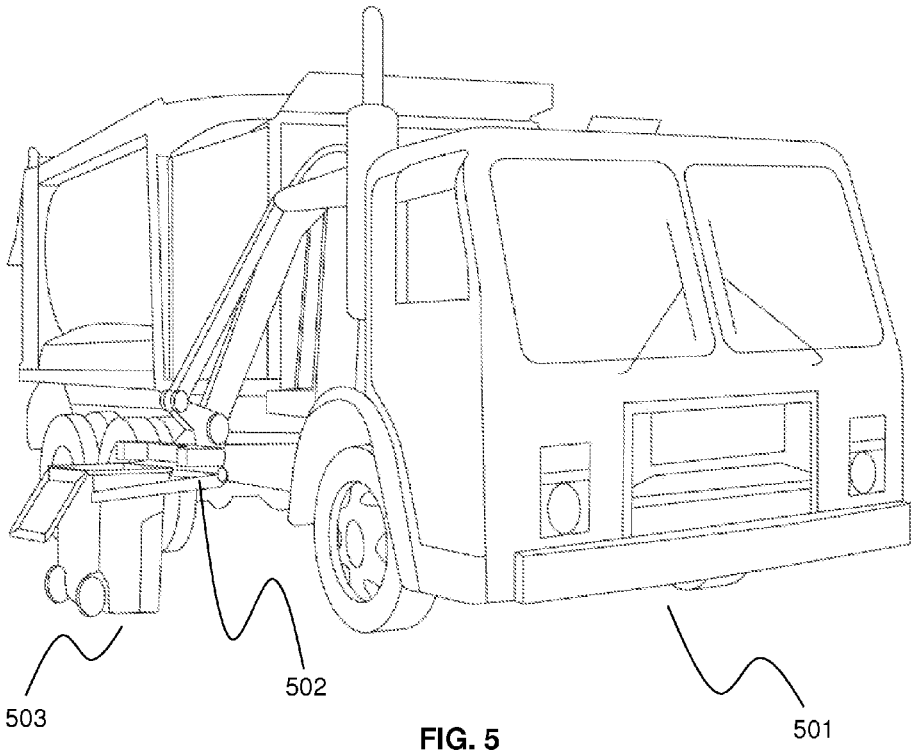
FIG. 5 is a perspective view of the collection vehicle picking up a trash container with its moving arms during the collection process.
Figure 6:
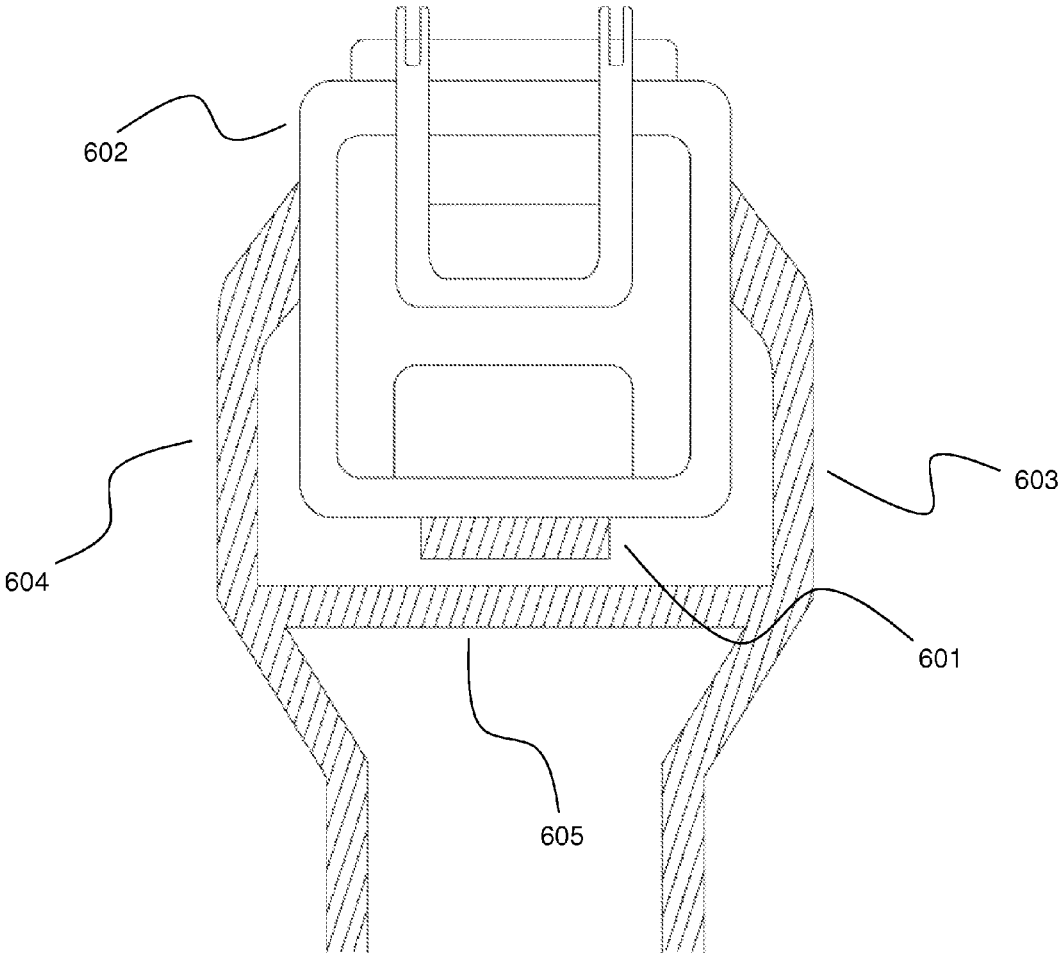
FIG. 6 is a top view of the trash container and the moving arms of the collection vehicle.

FIG. 5 shows a possible implementation where the collection vehicle 501 uses a mechanical arm 502 to lift the trash container 503. The mechanical arm of the collection vehicle marked 603-605 in FIG. 6, which has to lift the container 602, houses the wires carrying the authorization signals inside mechanical arm.

In one embodiment of this aspect, the connection between 603 and 604 and the sides of the trash container 602 can be used as a conductive connection to transfer the signals. This provides a two-wire method for signal transmission from the truck to the trash container. This signal unlocks the primary lock.

Figure 7:
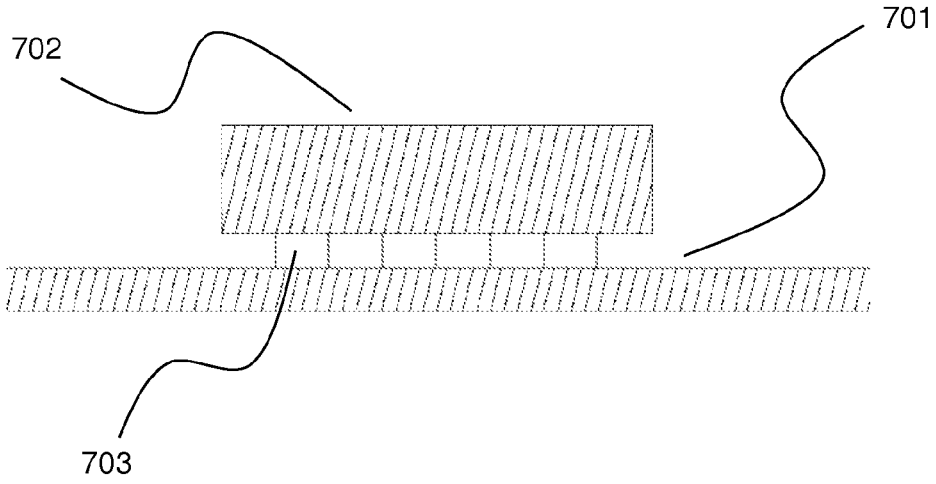
FIG. 7 is a top view of the part of the collection vehicle's moving arms, which contains the electronics needed for signal transmission in conjunction with the lock in a wired setting.

In another embodiment of this aspect, the part of the mechanical arm 605 that faces the lock 601 includes the wires carrying the authorization signals. As shown in FIG. 7, this part 701 touches the smart lock 702 and through a conductive contact 703 transfers the signal to the lock, where it is validated to open the primary lock.

Figure 8:
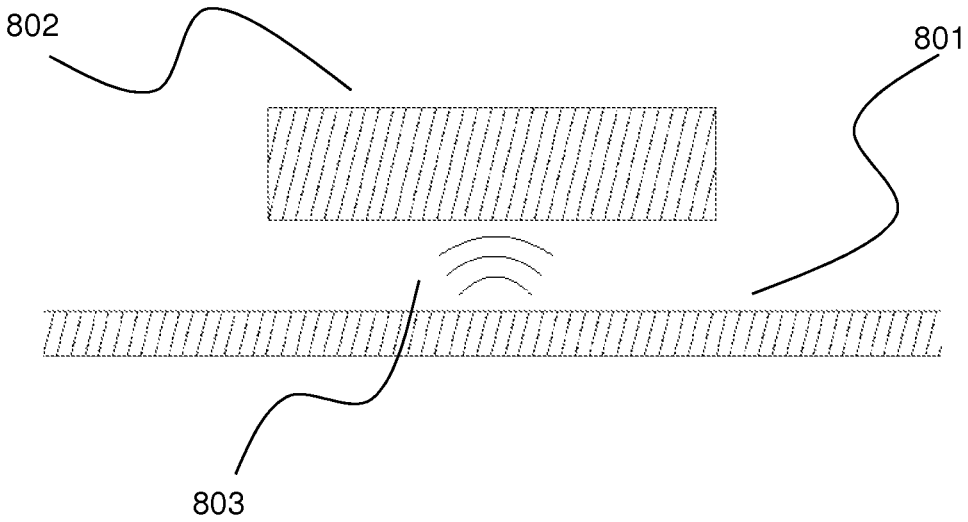
FIG. 8 is a top view of the part of the collection vehicle's moving arms, which contains the electronics needed for signal transmission in conjunction with the lock in a wireless setting.

In yet another embodiment of this aspect depicted in FIG. 8, the part of the mechanical arm 801 that faces the lock 802 houses the wires carrying the authorization signals. 801 sends the signal through a wireless link 803, to the smart lock 802, where it is validated to open the primary lock, using any of the publicly used communication protocols, such as infra-red connection, RFID, Bluetooth, WiFi, and other IEEE 802.11 suites of wireless connectivity, or proprietary communication protocols.

Figure 9:
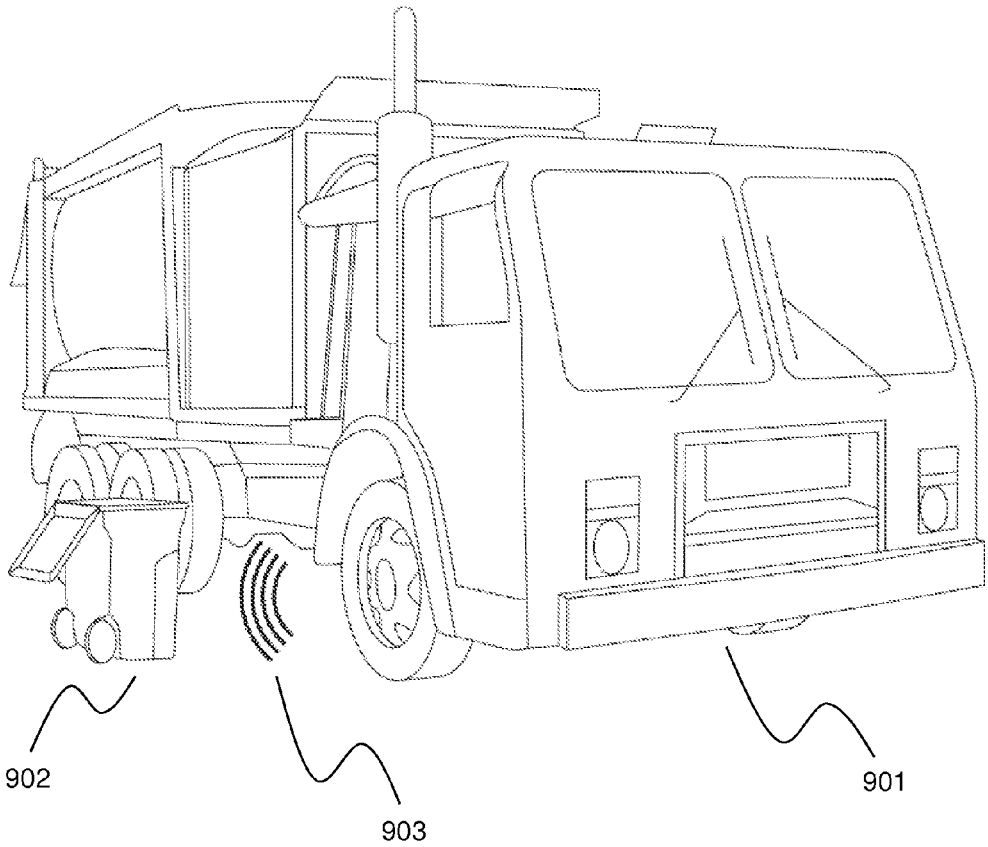
FIG. 9 shows the collection vehicle sending authentication signals to the trash container.

In another embodiment shown in FIG. 9 the primary lock in the trash container 902 detects the presence of the vehicle 901 through electrical signals with unique patterns that can be applied via a wireless link 903 to the lock from a transmitter installed inside the vehicle or carried by the vehicle operator. In this embodiment a wireless transmitter that can use any of the publicly used communication protocols such as infra-red connection, RFID, Bluetooth, WiFi, and other IEEE 802.11 suites of wireless connectivity, or proprietary communication protocols, sends the authentication signal to the lock, which, as described above, can unlock the primary lock.

In another embodiment, the lock is equipped with a magnetic card reader that can detect the presence of the authorized collection vehicle when a magnetic medium containing authentication information, such as a magnetic card, is swiped on or into it. This can open the primary lock.

In yet another embodiment, the lock is equipped with an image-processing device, such as, for example, a camera, that detects a certain visual signature of the truck. The visual signature can, for example, be the shape of the vehicle or a bar code printed on the side of it, or a visual signature of the operator, such as face recognition, finger print, etc., and opens the primary lock.

Another possible embodiment is one where the lock is equipped with an audio processing device such as a microphone that detects a unique audio signature of the vehicle or its operator and permits the primary lock to open.

Another possible embodiment is one where the lock is equipped with a proximity sensing device, such as a radar or sonar or infra red sensor that detects a certain distance from the vehicle, and permits the primary lock to open.

Several of the methods described above can be used to allow the owner of the trash container to unlock it. In particular, the RFID or magnetic cards are the most practical methods that can be used by the owner to unlock the trash container.

Figure 10:
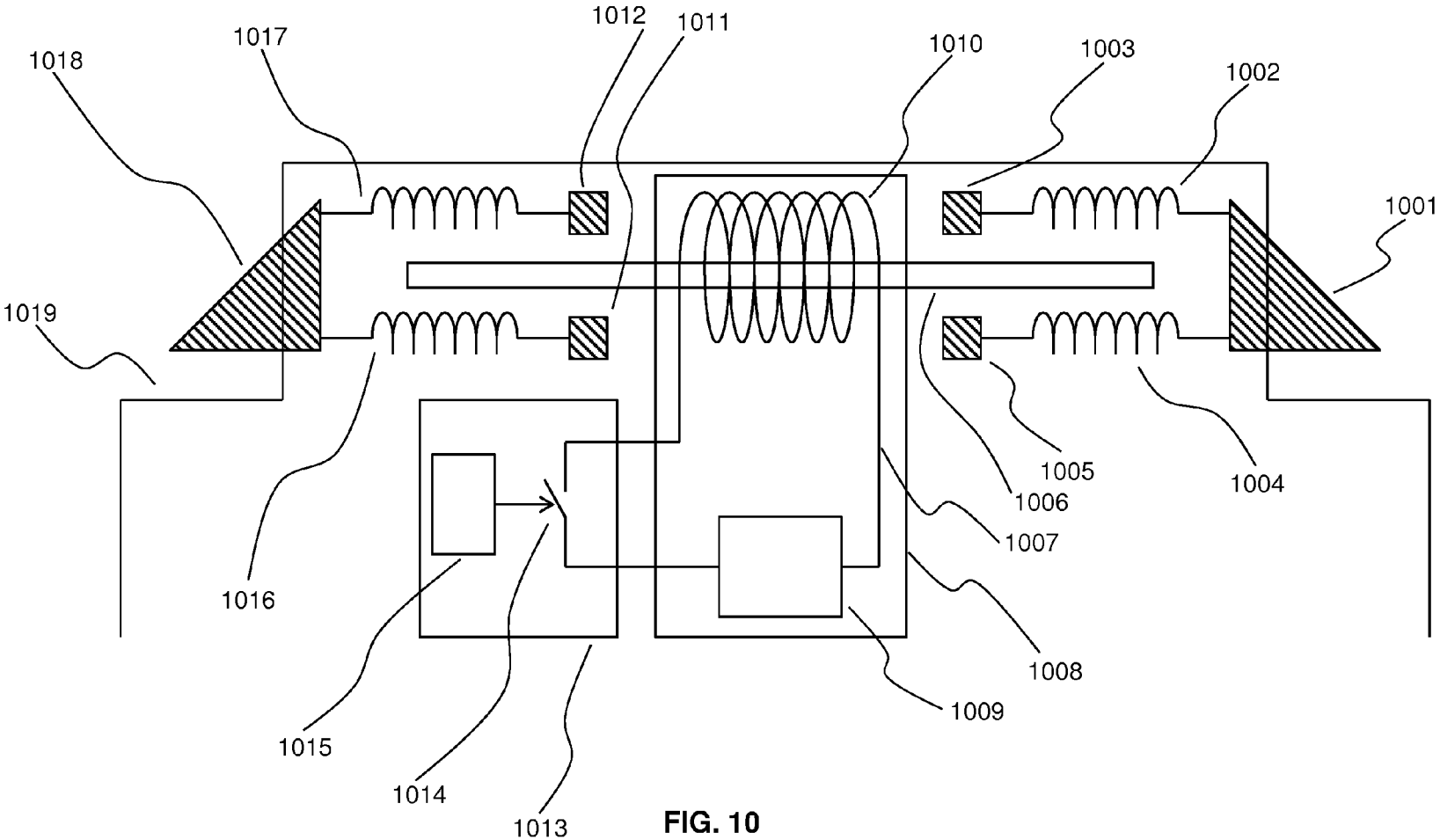
FIG. 10 shows the bottom part of the smart lock assembly and the details of one embodiment of the locking mechanism.

A variety of embodiments, which include all the abovementioned methods to implement the primary lock, can realize the secondary lock. An exemplary embodiment is shown in FIG. 10 which illustrates the interlocking mechanism and electrical embodiments of the primary and the secondary locks inside the bottom part of the smart lock 402. When the trash container is closed, the top part of the assembly 401, which is mounted on the trash container lid, moves down and pushes against the protruding latches 1001 and 1018. These latches are made of iron or a similar metal that can be affected in a magnetic field. Since the latches are pushed out by the force of small springs 1002, 1004, 1016, and 1017, the force of the descending top part of the assembly pushes 1001 and 1018 into the frame 1019, and the top 401 and the bottom 402 parts of the lock come into a complete contact, at which point the latches 1001 and 1018 will be released back by the force of the springs into the cavities 403 and 404, thereby interlocking the top and bottom parts and securing the trash container. Due to the force of the springs 1002, 1004, 1016, and 1017 which pushes the latches 1001 and 1018 out, pulling the lid up will not result in the opening of the trash container and the assembly remains locked. The primary lock 1013 in this embodiment consists of a detector/timer 1015 that detects one of the various abovementioned authentications such as a wireless signal from the collection vehicle and closes the switch 1014 for a predefined amount of time $t_1$. Only during this time, can the secondary lock 1008 be opened. If detector/timer 1009 detects one of the various abovementioned authentications such as the movement signature of the trash container being lifted then it will apply a current to the coil 1010 for a predefined amount of time $t_2$. Due to the current flowing in the coil, the magnetic core 1006 is magnetized and pulls the latches 1001 and 1008 into the assembly, thereby allowing the unlocking of the top part 401 attached to the lid and the bottom part 402 attached to the can. Without the closing of the switch 1014 the secondary lock 1008 cannot be activated as this switch is where the current needed to energize the coil 1010 will pass through.

In a different embodiment the secondary lock can be opened by use of mechanical and gravitational forces, gated by the primary lock.

In yet another embodiment, the secondary lock can be opened by the mechanical parts of the truck such as levers, lifting arms, etc.

Other embodiments of this secondary lock may include hydraulic action.

Figure 11:
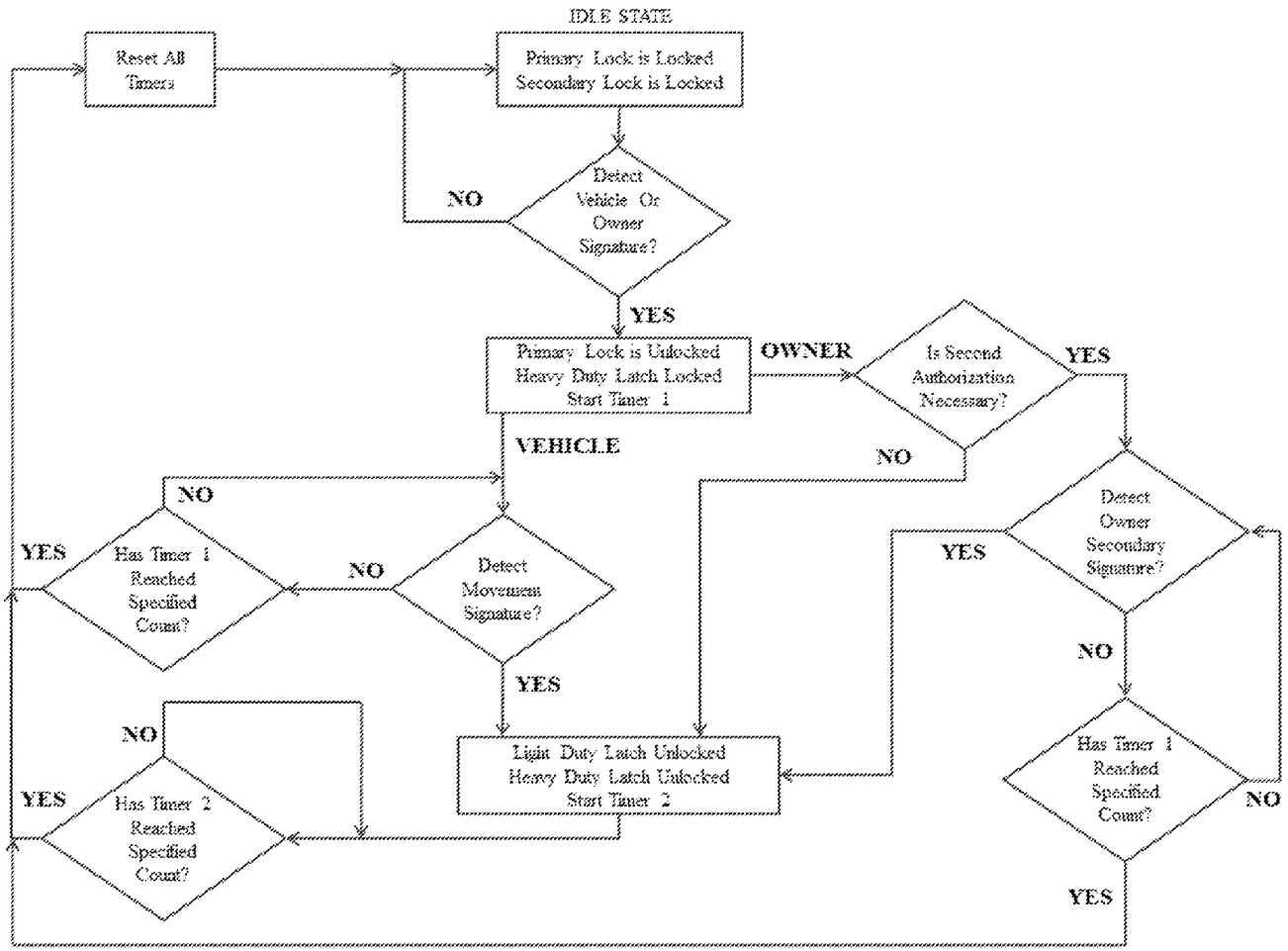
FIG. 11 shows a flow chart of for the locking algorithm of the smart lock.

FIG. 11 is the flow chart of the unlocking and locking algorithm implemented in the lock during the normal course of operation when a fault is not detected. In the idle state of this system both primary and secondary locks are locked. When either the presence of the collection vehicle is sensed by the smart lock or the owner issues an unlock signal a primary lock authentication scenario occurs. When a collection vehicle is detected and the primary lock is unlocked, for a specified period of $t_1$ the smart lock awaits the detection of movement signature or other signals needed to open the secondary lock. After the time $t_1$ lapses the secondary lock will no longer open and the system returns to the idle state. However, if the secondary lock is opened as a result of the detection of movement signature or other authentication signals, it remains open for a period $t_2$ which subsequently allows the collection vehicle to empty the trash container during this time. After the time $t_2$ lapses the system returns to the idle state. When the owner issues an unlock signal by various methods discussed above, the system can be designed to respond in at least two different ways: In one implementation, the system can open both the primary and the secondary locks so the owner can easily deposit trash into the container for a period equal to $t_1$, after which the locks close and the system returns to the idle state. A second and more secure implementation is one where a secondary authentication by the owner is necessary within time $t_1$ of the unlocking of the primary lock to open the secondary lock. For example the owner must turn a handle to open the secondary lock. After the secondary lock is opened, the owner can make the deposit into the trash container within a period of $t_2$ before the locks close and the system returns to the idle state.

The preceding sections presented various embodiments of an electronically augmented mechanical trash container locking mechanism and applications thereof to securely lock a trash container and prevent unauthorized entry. As one of average skill in the art will appreciate, other embodiments may be derived from the teaching of the present invention without deviating from the scope of the claims.

What is claimed is:

1. A trash container locking mechanism for locking a trash container comprising:

a top part attached or built into a trash container lid;

a bottom part attached or built into the trash container;

a locking mechanism consisting of at least two locks;

a primary lock operably connected to a secondary lock to conditionally allow or disallow unlocking of the secondary lock;

a sensor for the primary lock that detects a condition required to allow unlocking of the primary lock;

a timer for the primary lock that locks the primary lock after a specified time following the unlocking of the primary lock;

a secondary lock;

a sensor for the secondary lock that detects a separate condition required to allow the unlocking of the secondary lock;

a gating mechanism that allows the unlocking of the secondary lock only if the primary lock is unlocked;

a timer for the secondary lock that locks the secondary lock after a specified time following the unlocking of the secondary lock;

a battery or energy harvesting mechanism to supply power to the trash container locking mechanism;

a state machine that implements a locking and unlocking algorithm; and a fault detection mechanism that can unlock or lock the trash container locking mechanism according to a predefined setting.

2. The trash container locking mechanism of claim 1, wherein the top and the bottom parts can be retrofitted on an existing trash container.

3. The trash container locking mechanism of claim 1 wherein multiple locks function to:

secure the trash container by only allowing the primary lock to unlock when an unlock command from an owner or a presence of a collection vehicle is detected and by only allowing the secondary lock to open, if the primary lock is already open, with the command from the owner or if a signature characteristic of a trash collection process, such as a movement signature, is detected.

4. The trash container locking mechanism of claim 1 wherein the sensor for the primary lock functions to:

detect primary lock authentication scenarios when an unlock command from an owner or a presence of a collection vehicle is detected.

5. The trash container locking mechanism of claim 4 wherein the sensor for the primary lock detects the presence of the collection vehicle by receiving electrical signals from a transmitter in the collection vehicle through a wired connection.

6. The trash container locking mechanism of claim 5 wherein the wired connection to the collection vehicle is established through conductive contacts of lifting arms that establish a two-wire link.

7. The trash container locking mechanism of claim 5 wherein the wired connection to the collection vehicle is established through a signal bus that forms when the collection vehicle comes in contact with the trash container.

8. The trash container locking mechanism of claim 4 wherein the sensor for the primary lock detects the presence of the collection vehicle by receiving electrical signals from a transmitter in the collection vehicle through a wirelesses connection.

9. The trash container locking mechanism of claim 8 wherein the wireless connection to the collection vehicle is established through at least one of publicly used communication protocols, including infra-red connection, RFID, Bluetooth, WiFi, and other IEEE 802.11 suites of wireless connectivity, or proprietary communication protocols.

10. The trash container locking mechanism of claim 5 or 8 wherein the signal transmitter is installed in the collection vehicle.

11. The trash container locking mechanism of claim 5 or 8 wherein the signal transmitter can be carried by a collection vehicle operator.

12. The trash container locking mechanism of claim 4 wherein the sensor for the primary lock can read an authentication signal from a magnetic medium such as a magnetic card carried by a collection vehicle operator or the owner.

13. The trash container locking mechanism of claim 4 wherein the sensor for the primary lock is equipped with an image-processing device that detects a visual signature of the collection vehicle or an operator of the collection vehicle.

14. The trash container locking mechanism of claim 4 wherein the sensor for the primary lock is equipped with an audio processing device that detects a unique audio signature of the collection vehicle or an operator of the collection vehicle.

15. The trash container locking mechanism of claim 4 wherein the sensor for the primary lock is equipped with a proximity sensing device, that detects a certain distance from the collection vehicle.

16. The trash container locking mechanism of claim 4 wherein the sensor for the primary lock detects the unlock command from the owner when the sensor for the primary lock receives signals from a wireless transmitter that the owner operates through a wireless connection.

17. The trash container locking mechanism of claim 16 wherein the wireless connection to the transmitter operated by the owner is established through at least one of publicly used communication protocols, including infra-red connection, RFID, Bluetooth, WiFi, and other IEEE 802.11 suites of wireless connectivity, or proprietary communication protocols.

18. The trash container locking mechanism of claim 1 wherein the primary lock functions to:

unlock when primary lock authentication scenarios are detected and enable the secondary lock for a limited amount of time.

19. The trash container locking mechanism of claim 18 wherein the primary lock can be magnetically, mechanically, electronically, hydraulically, or by the force of vacuum, locked and unlocked.

20. The trash container locking mechanism of claim 18 wherein the timer for the primary lock starts counting for a time interval of $t_1$ when the primary lock is unlocked; the timer for the primary locks the primary lock again as soon as the time $t_1$ lapses.

21. The trash container locking mechanism of claim 20 wherein the sensor for the secondary lock detects a motion signature unique to a collection process.

22. The trash container locking mechanism of claim 21 wherein the sensor for the secondary lock detects a secondary authentication command from an owner.

23. The trash container locking mechanism of claim 1 wherein the secondary lock functions to:

unlock when the primary lock has been unlocked and either a signature unique to a collection process or an owner's secondary authentication command is detected.

24. The trash container locking mechanism of claim 23 wherein the secondary lock can be magnetically, mechanically, electronically, hydraulically, or by the force of vacuum, locked and unlocked.

25. The trash container locking mechanism of claim 23 wherein the timer for the secondary lock starts counting for a time interval of $t_2$ when the primary lock is unlocked; the timer for the secondary lock locks the secondary lock again as soon as the time $t_2$ lapses.

26. The trash container locking mechanism of claim 1 wherein solar panels are used to power the trash container locking mechanism.

27. The trash container locking mechanism of claim 1 wherein batteries are used to power the trash container locking mechanism.

28. The trash container locking mechanism of claim 1 wherein energy harvesting mechanisms are used to power the trash container locking mechanism.

29. The trash container locking mechanism of claim 1 wherein the fault detection mechanism functions to:

detect a fault situation such as low battery or dysfunctional sensors, and unconditionally lock or unlock the trash container depending on a predefined setting.

30. The trash container locking mechanism of claim 1 wherein the algorithm is built into the state machine in a system that schedules and enables the locking and unlocking of the primary and the secondary locks such that the trash container can be opened only when an owner issues an unlock command or when a collection vehicle and a unique collection signature is detected; after a specific time following the unlocking of the trash container, the state machine securely re-locks the trash container.

* * * * *